US005496418A

United States Patent [19]

Ramanan et al.

[11] Patent Number: 5,496,418

[45] Date of Patent: Mar. 5, 1996

[54] AMORPHOUS FE-B-SI ALLOYS EXHIBITING ENHANCED AC MAGNETIC PROPERTIES AND HANDLEABILITY

[75] Inventors: V. R. V. Ramanan, Dover; Howard H. Liebermann, Succasunna, both of N.J.

[73] Assignee: AlliedSignal Inc., Morristown, N.J.

[21] Appl. No.: 397,317

[22] Filed: Mar. 2, 1995

Related U.S. Application Data

[63] Continuation of Ser. No. 259,736, Jun. 10, 1994, abandoned, which is a continuation of Ser. No. 25,715, Mar. 2, 1993, abandoned, which is a continuation of Ser. No. 938,320, Aug. 31, 1992, abandoned, which is a continuation of Ser. No. 832,633, Feb. 7, 1992, abandoned, which is a continuation of Ser. No. 660,166, Feb. 25, 1991, abandoned, which is a continuation of Ser. No. 479,489, Feb. 13, 1990, abandoned.

[51] Int. Cl.[6] ..... C22C 38/02

[52] U.S. Cl. ..... 148/304; 148/307; 420/117; 420/121

[58] Field of Search ..... 148/304, 307, 148/403; 420/117, 121

[56] References Cited

U.S. PATENT DOCUMENTS

| | | | |
|---|---|---|---|
| 32,925 | 5/1889 | Chen et al. | 148/403 |
| 4,217,135 | 8/1980 | Luborsky et al. | 75/123 |
| 4,300,950 | 11/1981 | Luborsky et al. | 75/123 |
| 4,437,907 | 3/1984 | Sato et al. | 148/304 |
| 4,734,975 | 4/1988 | Ballard et al. | 29/606 |
| 5,370,749 | 12/1994 | Ames et al. | 148/304 |

FOREIGN PATENT DOCUMENTS

| | | | |
|---|---|---|---|
| 58269 | 8/1982 | European Pat. Off. . | |
| 177669 | 4/1986 | European Pat. Off. . | |
| 7910035 | 4/1978 | France . | |
| 7910034 | 4/1979 | France . | |
| 2915765 | 4/1979 | Germany . | |
| 56-122749 | 5/1980 | Japan . | |
| 152150 | 11/1980 | Japan . | |
| 58-34162 | 2/1983 | Japan | 148/304 |
| 60-81805 | 5/1985 | Japan . | |
| 233198 | 10/1985 | Japan . | |
| 62-93339 | 4/1987 | Japan . | |

OTHER PUBLICATIONS

Joung et al., "Magnetic Properties and Magnetic Annealing of Fe–B–Si Amorphous Alloys with Different Si Content", Journal of the Korean Institute of Metals 24 (11), pp. 42–48, (1986).

Hoselitz, "Magnetic Properties of Iron–Boron–Silicon Metallic Glasses", Journal of Magnetism and Magnetic Materials 20, pp. 201–206, (1980).

(List continued on next page.)

*Primary Examiner*—Deborah Yee
*Attorney, Agent, or Firm*—Ernest D. Buff; Roger H. Criss

[57] ABSTRACT

This invention is directed to metallic alloy consisting essentially of iron, boron and silicon and having a composition in the region A, B, C, D, E, F, A of FIG. 1, said alloy having a crystallization temperature of at least about 490° C., a saturation magnetization value of at least about 174 emu/g at 25° C., a core loss not greater than about 0.3 W/kg, measured at 25° C., 60 Hz and 1.4 T after having been annealed at 360° C. for about 2000 seconds, a core loss not greater than about 0.3 W/kg, measured at 25° C., 60 Hz and 1.4 T after having been annealed at about 380° C. for a time ranging from about 1000 to about 2000 seconds, an exciting power requirement not greater than about 1 VA/kg, measured at 25° C., 60 Hz and 1.4 T after having been annealed at 360° C. for about 2000 seconds, an exciting power requirement not greater than about 1 VA/kg, measured at 25° C., 60 Hz and 1.4 T after having been annealed at 380° C. for about 1000 seconds, a fracture strain of at least about 0.03, measured at 25° C. for the alloy after having been annealed at about 360° C. for about 1.5 hours, and a fracture strain of at least about 0.03, measured at 25° C. for the alloy after having been annealed at about 380° C. for about 1.5 hours. The alloys exhibit improved utility and handleability in the production of magnetic cores used in the manufacture of electric distribution and power transformers.

14 Claims, 9 Drawing Sheets

OTHER PUBLICATIONS

Masumoto, "Designing the Composition and Heat Treatment of Magnetic Amorphous Alloys", Materials Science and Engineering 48, pp. 147–165, (1981).

Naka et al., "Effect of Metalloidal Elements on the Thermal Stability of Amorphous Iron–Base Alloys", Supplement to Sci. Rep. *RITU A*, 27, pp. 118–126, (1979).

Jaschinski et al., "Magnetic Properties of Amorphous FeSiB Alloys", *NTG–Fachberichte* 76, VDE–Verlag GmbH, Berlin, pp. 307–311 (translation pp. 1–6), (1980).

Hoselitz, "Magnetic Iron–Silicon–Boron Metallic Glasses", *Rapidly Quenched Metals III*, vol. 2, The Metals Society, London, pp. 245–248, (1978).

Narita et al., "Compositional Effects on Magnetic Properties on Fe–Si–B Glassy Alloys", Journal of Magnetism and Magnetic Materials 19, pp. 145–146, (1980).

Nagumo et al., "Glass Forming Ability of Fe–Base Alloys", Supplement to Sci. Rep. *RITU A*, 28, pp. 136–142, (1980).

Yavari, "Absence of Thermal Embrittlement in some Fe–B and Fe–B–Si Glassy Alloys", Materials Science and Engineering 98, pp. 491–493 (Aug. 3, 1987).

Wolf et al. "Soft Magnetic Low–Cost Amorphous Fe–B–Si Alloys, Their Properties and Potential Uses," Journal of Magnetism and Magnetic Materials 19, pp. 177–182 (Sep. 14, 1979).

U.S. Patent Application Serial No. 235,064, filed Feb. 17, 1981, now U.S. Patent No. 5,370,749 to Ames et al.

U.S. Patent Application Serial No. 883,870, filed Jul. 14, 1986, now U.S. Patent No. 5,035,755 Nathasingh et al.

●& ■ 360° C
○& ◆ 380° C
1000 S ANNEALS
>5
EXCITING POWER
AT 60Hz, 1.4 T (VA/kg)
0
1
2
3
4
5
Fe(at%)
B(at%)
79 10
79 11
79.5 10
79.5 11
79.5 12.2
79.8 9.8
79.8 11
79.8 11.5
80 8
80 9
80 9.5
80 10
80 11
80 11.5
80.1 9.8
80.3 10.5
80.5 9.5
80.5 10.5
80.5 10.8
80.5 11
81 8
81 9
81 10
81 11
81 12.5
81.5 9.5
82 8
82 9
82 10
82 11
A
B
C
D
E
F
1
2
3
5

●&■360°C
○&◆380°C
2000 S ANNEALS
EXCITING POWER
AT 60Hz, 1.4 T (VA/kg)
0
1
2
3
4
5
Fe(at%)
B(at%)
79 79 79.5 79.5 79.5 79.5 79.8 79.8 79.8 80 80 80 80 80 80 80.1 80.3 80.5 80.5 80.5 80.5 81 81 81 81 81 81.5 82 82 82
10 11 10 11 12.2 9.8 11 11.5 8 9 9.5 10 11 11.5 9.8 10.5 9.5 10.5 10.8 11 8 9 10 11 12.5 9.5 8 9 10 11
B 1 C 5 D A 3 F 2 E

AMORPHOUS FE-B-SI ALLOYS EXHIBITING ENHANCED AC MAGNETIC PROPERTIES AND HANDLEABILITY

This application is a file-wrapper continuation of application Ser. No. 08/259,736, filed Jun. 10, 1994 which, in turn is a file-wrapper continuation of application Ser. No. 025,715, filed Mar. 2, 1993 which, in turn is a file-wrapper continuation of application Ser. No. 938,320, filed Aug. 31, 1992 which, in turn, is a file-wrapper continuation of application Ser. No. 832,633, filed Feb. 7, 1992 which, in turn, is a file-wrapper continuation of application Ser. No. 660,166, filed Feb. 25, 1991 which, in turn is a file-wrapper continuation of application Ser. No. 479,489, filed Feb. 13, 1990, now all abandoned.

FIELD OF THE INVENTION

The invention is directed to amorphous metallic alloys consisting essentially of iron, boron and silicon. The alloys have high saturation induction, high crystallization temperature and a combination of low core loss, low exciting power and good ductility over a range of annealing conditions as compared to prior art alloys, resulting in improved utility and handleability of the alloys in the production of magnetic cores used in the manufacture of electric distribution and power transformers.

BACKGROUND OF THE INVENTION

Amorphous metallic alloys substantially lack any long range atomic order and are characterized by X-ray diffraction patterns consisting of diffuse (broad) intensity maxima, quantitatively similar to the diffraction patterns observed for liquids or inorganic oxide glasses. However, upon heating to a sufficiently high temperature, they begin to crystallize with evolution of the heat of crystallization; correspondingly, the X-ray diffraction pattern thereby begins to change from that observed for amorphous to that observed for crystalline materials. Consequently, metallic alloys in the amorphous form are in a metastable state. This metastable state of the alloy offers significant advantages over the crystalline form of the alloy, particularly with respect to the mechanical and magnetic properties of the alloy.

Understanding which alloys can be produced economically and in large quantities in the amorphous form and the properties of alloys in the amorphous form has been the subject of considerable research over the past 20 years. The most well-known disclosure directed to the issue—What alloys can be more easily produced in the amorphous form?—is U.S. Pat. No. Re 32,925, to H. S. Chen and D. E. Polk, assigned to Allied-Signal Inc. Disclosed therein is a class of amorphous metallic alloys having the formula $M_aY_bZ_c$, where M is a metal consisting essentially of a metal selected from the group of iron, nickel, cobalt, chromium, and vanadium, Y is at least one element selected from the group of phosphorus, boron and carbon, Z is at least one element from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. Today, the vast majority of commercially available amorphous metallic alloys are within the scope of the above-recited formula.

With continuing research and development in the area of amorphous metallic alloys, it has become apparent that certain alloys and alloy systems possess magnetic and physical properties which enhance their utility in certain applications of worldwide importance, particularly in electrical applications as core materials for distribution and power transformers, generators and electric motors.

Early research and development in the area of amorphous metallic alloys identified a binary alloy, $Fe_{80}B_{20}$, as a candidate alloy for use in the manufacture of magnetic cores employed in transformers, particularly distribution transformers, and generators because the alloy exhibited a high saturation magnetization value (about 178 emu/g). It is known, however, that $Fe_{80}B_{20}$ is difficult to cast into amorphous form. Moreover, it tends to be thermally unstable because of a low crystallization temperature and is difficult to produce in ductile strip form. Further, it has been determined that its core loss and exciting power requirements are only minimally acceptable. Thus, alloys of improved castability and stability, and improved magnetic properties, had to be developed to enable the practical use of amorphous metallic alloys in the manufacture of magnetic cores, especially magnetic cores for distribution transformers.

Ternary alloys of Fe—B—Si were identified as superior to $Fe_{80}B_{20}$ for use in such applications by Luborsky et al. in U.S. Pat. Nos. 4,217,135 and 4,300,950. These patents disclose a class of alloys represented generally by the formula $Fe_{80-84}B_{12-19}Si_{18}$ subject, however, to the provisos that the alloys must exhibit a saturation magnetization value of at least about 174 emu/g (a value presently recognized as the preferred value) at 30° C., a coercivity less than about 0.03 Oersteds and a crystallization temperature of at least about 320° C.

Subsequent to Luborsky et al., it was disclosed in application Ser. No. 220,602, to Freilich et al., assigned to Allied-Signal Inc., that a class of Fe—B—Si alloys represented by the formula $Fe_{\approx 75-78.5}B_{26\ 11\approx 21}Si_{\approx 4\approx 10.5}$ exhibited high crystallization temperature combined with low core loss and low exciting power requirements at conditions approximating the ordinary operating conditions of magnetic cores in distribution transformers (i.e., 60 Hz, 1.4 T at 100° C.), while maintaining acceptably high saturation magnetization values.

U.S. patent application Ser. No. 235,064 discloses a class of Fe—B—Si alloys represented by the formula $Fe_{77-80}B_{12-16}Si_{5-10}$ and discloses that these alloys exhibit low core loss and low coercivity at room temperature after aging, and have high saturation magnetization values.

More recently, U.S. Pat. No. 4,437,907 disclosed a class of Fe—B—Si alloys represented by the formula $Fe_{74-80}B_{6-13}Si_{8-19}$, optionally containing up to 3.5 atom percent carbon, which alloys exhibit after aging a high degree of retention of the original magnetic flux density of the alloy (measured at 1 Oe and room temperature).

In addition, U.S. application Ser. No. 883,870, filed Jul. 14, 1986, to Nathasingh et al., assigned to Allied-Signal Inc., discloses a class of alloys useful for manufacture of magnetic cores for distribution transformers which are represented by the formula $Fe_{79.4-79.8}B_{12-14}Si_{6-8}$, which alloys exhibit unexpectedly low core loss and exciting power requirements both before and after aging in combination with an acceptably high saturation magnetization value.

It is readily apparent from the above discussion that researchers focused on different properties as being critical to the determination of which alloys would be best suited for the manufacture of magnetic cores for distribution and power transformers, but none recognized the combination of properties necessary for clearly superior results in all aspects of the production and operation of magnetic cores and, consequently, a variety of different alloys were discovered, each focusing on only part of the total combination. More specifically, conspicuously absent from the above recited disclosures is an appreciation for a class of alloys wherein the alloys exhibit a high crystallization temperature and a high saturation magnetization value, in combination with low core loss and low exciting power requirements after having been annealed over a wide range of annealing temperatures and times and, in addition, retain their ductility over a range of annealing conditions. Alloys which exhibit this combination of features would find overwhelming acceptance in the transformer manufacturing industry because they would possess the magnetic characteristics essential to improved operation of the transformer and more readily accommodate variations in the equipment, processes and handling techniques employed by different transformer core manufacturers.

BRIEF DESCRIPTION OF THE INVENTION

The present invention is directed to novel metallic alloys consisting essentially of iron, boron and silicon and having a composition in the region A, B, C, D, E, F, A, illustrated in FIG. 1, said alloys exhibiting a crystallization temperature of at least about 490° C., a saturation magnetization value of at least about 174 emu/g at 25° C., a core loss not greater than about 0.3 W/kg and an exciting power value not greater than about 1 VA/kg, measured at 25° C., 60 Hz and 1.4 T after having been annealed at 360° C. for about two thousand seconds, a core loss not greater than about 0.3 W/kg and an exciting power value not greater than about 1 VA/kg, measured at 25° C., 60 Hz and 1.4 T after having been annealed at about 380° C. for a time ranging from about one thousand to about two thousand seconds, and a fracture strain of at least about 0.03, measured at 20° C. for an alloy after having been annealed at about 360° C. for about 1.5 hours or at about 380° C. for about 1.5 hours.

The present invention is more particularly directed to amorphous metallic alloys consisting essentially of iron, boron, and silicon, wherein boron is present in an amount ranging from about 10.5 to about 11.5 atom percent, silicon is present in an amount ranging from about 8.5 to about 9.5 atom percent and iron is present in an amount of at least 80 atom percent, and having the above-recited properties.

The present invention is also drawn to improved magnetic cores comprising such amorphous alloys. The improved magnetic cores comprise a body (e.g., wound, wound and cut, or stacked) of an above-described amorphous metallic alloy, said body having been annealed in the presence of a magnetic field.

DETAILED DESCRIPTION OF THE INVENTION

Figure 1:
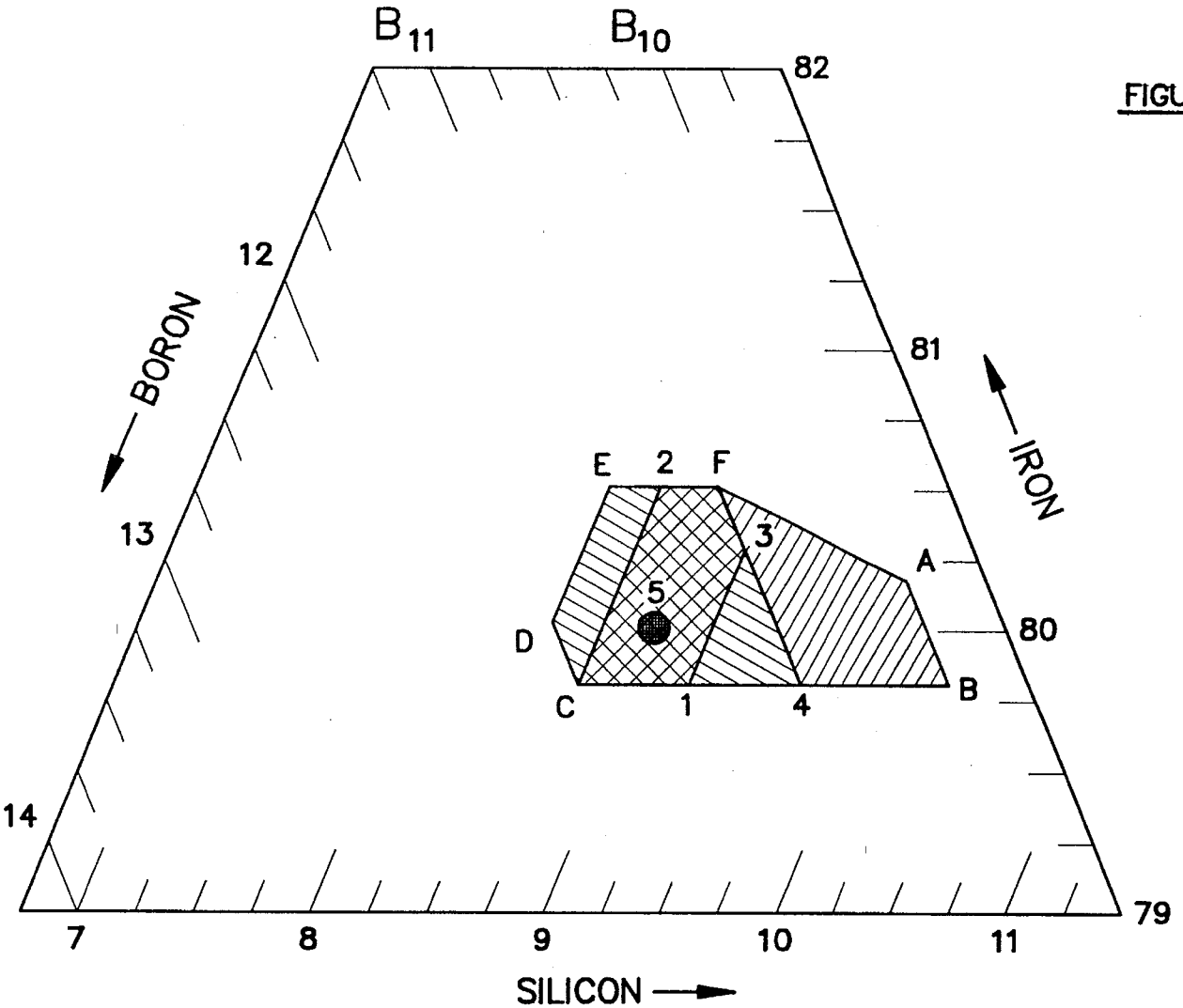
FIG. 1 is a ternary diagram which illustrates the basic, preferred and most preferred alloys of the present invention.

The present invention is directed to metallic alloys consisting essentially of iron, boron and silicon and having a composition in the region A, B, C, D, E, F, A illustrated in the ternary diagram of FIG. 1. More specifically, referring to FIG. 1, the alloys of the present invention are delimited by a polygon defined at corners thereof by alloys (in atom percent) having the composition $Fe_{80.15}B_{9.8}$ $Si_{10.05}$, $Fe_{79.8}B_{9.8}Si_{10.4}$, $Fe_{79.8}B_{11.5}Si_{8.7}$, $Fe_{80}B_{11.5}Si_{8.5}$, $Fe_{80.5}B_{11}Si_{8.5}$, and $Fe_{80.5}B_{10.5}Si_{9}$. It should be understood, however, that the compositions which delimit the boundaries of the polygon may vary in any constituent by as much as ±0.1 atom percent. The preferred alloys of the present invention have a composition in the region 4, C, D, E, F, 4 of FIG. 1. Again, the alloys delimiting the boundaries of the region of preferred alloys may vary in any constituent by ±0.1 atom percent. The most preferred alloys of the present invention have a composition in the region 1, C, 2, F, 3, 1 of FIG. 1. The alloys delimiting the boundaries of the most preferred region vary only in boron or silicon in an amount not greater in either constituent than ±0.1 atom percent. Finally, the most preferred alloy of the present invention consists essentially of about 80 atom percent iron, about 11 atom percent boron and about 9 atom percent silicon. It should be understood that the purity of the alloys of the present invention is , of course, dependent upon the purity of the materials employed to produce the alloys. Accordingly, the alloys of the present invention can contain as much as 0.5 atom percent impurities, but preferably contain not more than 0.3 atom percent impurities.

As is well known, the magnetic properties of alloys cast to a metastable state generally improve with increased volume percent of amorphous phase. Accordingly, the alloys of the present invention are cast so as to be at least about 90% amorphous (by volume), preferably at least about 97% amorphous and, most preferably essentially 100% amorphous. The volume percent of amorphous phase in the alloy is conveniently determined by X-ray diffraction.

The metallic alloys of the present invention are produced generally by cooling a melt at a rate of at least about $10^5$ to $10^{6o}$ C./s. A variety of techniques are available for fabricating amorphous metallic alloys within the scope of the invention such as, for example, spray depositing onto a chilled substrate, jet casting, planar flow casting, etc. Typically, the particular composition is selected, powders or granules of the requisite elements (or of materials that decompose to form the elements, such as ferroboron, ferrosilicon, etc.) in the desired proportions are then melted and homogenized, and the molten alloy is thereafter supplied to a chill surface, capable of quenching the alloy at a rate of at least about $10^5$ to $10^{6\circ}$ C./s.

The most preferred process for fabricating continuous metallic strip composed of the alloys of the invention is the process known as planar flow casting, set forth in U.S. Pat. No. 4,142,571, to Narasimhan, assigned to Allied-Signal Inc., which is incorporated herein by reference thereto. The planar flow casting process comprises the steps of (a) moving the surface of a chill body in a longitudinal direction at a predetermined velocity of from about 100 to about 2000 meters per minute past the orifice of a nozzle defined by a pair of generally parallel lips delimiting a slotted opening located proximate to the surface of the chill body such that the gap between the lips and the surface changes from about 0.03 to about 1 millimeter, the orifice being arranged generally perpendicular to the direction of movement of the chill body, and (b) forcing a stream of molten alloy through the orifice of the nozzle into contact with the surface of the moving chill body to permit the alloy to solidify thereon to form a continuous strip. Preferably, the nozzle slot has a width of from about 0.3 to 1 millimeter, the first lip has a width at least equal to the width of the slot and the second lip has a width of from about 1.5 to 3 times the width of the slot. Metallic strip produced in accordance with the Narasimhan process can have widths ranging from 7 millimeters, or less, to 150 to 200 mm, or more. Amorphous metallic strip composed of alloys of the present invention is generally about 0.025 millimeters thick, but the planar flow casting process described in U.S. Pat. No. 4,142,571 is capable of producing amorphous metallic strip ranging from less than 0.025 millimeters in thickness to about 0.14 millimeters or more, depending on the composition, melting point, solidification and crystallization characteristics of the alloy employed.

The alloys of the present invention are unique in that they offer the unexpected combination of improved handleability in the manufacture of magnetic cores and excellent magnetic properties over a wide range of annealing conditions.

In the production of magnetic cores from amorphous metallic alloy strip (metallic glass) for use in distribution and power transformers, the metallic glass, either before or after being wound into a core, is subjected to annealing. Annealing (or, synonymously, heat treatment), usually in the presence of an applied magnetic field, is necessary before the metallic glass will display its excellent soft magnetic characteristics because as-cast metallic glasses exhibit a high degree of quenched-in stress which causes significant stress-induced magnetic anisotropy. This anisotropy masks the true softmagnetic properties of the product and is removed by annealing the product at suitably chosen temperatures at which the induced quenched-in stresses are relieved. Obviously, the annealing temperature must be below the crystallization temperature. Since annealing is a dynamic process, the higher the annealing temperature, the shorter the time period needed to anneal the product. For these and other reasons to be explained below, the optimum annealing temperature is presently in the very narrow range of from about 120 K. to 110 K. below the crystallization temperature of the metallic glass, and the optimum annealing time is about 1.5–2.0 hours.

Metallic glasses exhibit no magnetocrystalline anisotropy, a fact attributable to their amorphous nature. However, in the production of magnetic cores, especially those for use in distribution transformers, it is highly desirable to maximize the magnetic anisotropy of the alloy along a preferred axis aligned with the length of the strip. In fact, presently, it is believed to be the preferred practice of transformer core manufacturers to apply a magnetic field to the metallic glass during the annealing step in order to induce a preferred axis of magnetization.

The field strength ordinarily applied during annealing is sufficient to saturate the material in order to maximize the induced anisotropy. Considering that the saturation magnetization value decreases with increasing temperature until the Curie temperature is reached, above which temperature no further modification of magnetic anisotropy is possible, annealing is preferably carried out at temperatures close to the Curie temperature of the metallic glass so as to maximize the effect of the external magnetic field. Of course, the lower the annealing temperature, the longer the time (and higher the applied magnetic field strength) necessary to relieve the cast-in anisotropies and to induce a preferred anisotropy axis.

It should be apparent from the above discussion that selection of the annealing temperature and time depends in large part on the crystallization temperature and Curie temperature-of the material. In addition to these factors, an important consideration in selecting annealing temperature and time is the effect of the anneal on the ductility of the product. In the manufacture of magnetic cores for distribution and power transformers, the metallic glass must be sufficiently ductile so as to be wound into the core shape and to enable it to be handled after having been annealed, especially during subsequent transformer manufacturing steps such as the step of lacing the annealed metallic glass through the transformer coil. (For a detailed discussion of the process of manufacturing transformer core and coil assemblies see, for example, U.S. Pat. No. 4,734,975.)

Annealing of iron-rich metallic glass results in degradation of the ductility of the alloy. While the mechanism responsible for degradation prior to crystallization is not clear, it is generally believed to be associated with the dissipation of the "free volume" quenched into the as-cast metallic glass. The "free volume" in a glassy atomic structure is analogous to vacancies in a crystalline atomic structure. When a metallic glass is annealed, this "free volume" is dissipated as the amorphous structure tends to relax into a lower energy state represented by a more efficient atomic "packing" in the amorphous state. Without wishing to be bound by any theory, it is believed that since the packing of Fe-base alloys in the amorphous state more closely resembles that of a face centered cubic structure (a close-packed crystalline structure) rather than the body centered cubic structure of iron, the more relaxed the iron-base metallic glass, the more brittle it is (i.e., less able it is to tolerate external strain) . Therefore, as the annealing temperature and/or time increase, the ductility of the metallic glass decreases. Consequently, apart from the fundamental issue of alloy composition, one must consider the effects of annealing temperature and time to further ensure that the product retains sufficient ductility to be used in the production of transformer cores.

Fracture strain is the parameter measured to determine relative ductility of metallic glasses. Quite simply, it is measured by bending a sample of metallic glass between two platens, usually the platens of a micrometer, until the sample fractures (breaks). The separation distance (d) between the platens on fracture is noted, the thickness (t) of the strip is measured and the fracture strain ($\epsilon = t/(d-t)$) is calculated. Presently, transformer core manufacturers employ a metallic glass exhibiting a fracture stain after annealing of about 0.03 or less, which corresponds to a degree of ductility such that the strip can only be bent to a round radius not smaller than about 17 times its thickness without fracture.

When the magnetic cores of annealed metallic glass are energized (i.e., magnetized by the application of a magnetic field) a certain amount of the input energy is consumed by the core and is lost irrevocably as heat. This energy consumption is caused primarily by the energy required to align all the magnetic domains in the metallic glass in the direction of the field. This lost energy is referred to as core loss, and is represented quantitatively as the area circumscribed by the B—H loop generated during one complete magnetization cycle of the material. The core loss is ordinarily reported in units of W/kg, which actually represents the energy lost in one second by a kilogram of material under the reported conditions of frequency, core induction level and temperature.

Core loss is affected by the annealing history of the metallic glass. Put simply, core loss depends upon whether the glass is under-annealed, optimally annealed or over-annealed. Under-annealed glasses have residual, quenched-in stresses and related magnetic anisotropies which require additional energy during magnetization of the product and result in increased core losses during magnetic cycling. Over-annealed alloys are believed to exhibit maximum "packing" and/or can contain crystalline phases, the result of which is a loss of ductility and/or inferior magnetic properties such as increased core loss caused by increased resistance to movement of the magnetic domains. Optimally annealed alloys exhibit a fine balance between ductility and magnetic properties. Presently, transformer manufacturers utilize amorphous alloy exhibiting core loss values of less than 0.37 W/kg (60 Hz and 1.4 T at 25° C.) in combination with fracture strain of about 0.03 or less.

Exciting power is the electrical energy required to produce a magnetic field of sufficient strength to achieve in the metallic glass a given level of magnetization. An as-cast iron-rich amorphous metallic alloy exhibits a B—H loop which is somewhat sheared over. During annealing, as as-cast anisotropies and cast-in stresses are relieved, the B—H loop becomes more square and narrower relative to the as-cast loop shape until it is optimally annealed. Upon over-annealing, the B—H loop tends to broaden as a result of reduced tolerance to strain and, depending upon the degree of over-annealing, existence of crystalline phases. Thus, as the annealing process for a given alloy progresses from under-annealed to optimally annealed to over-annealed, the value of H for a given level of magnetization initially decreases, then reaches an optimum (lowest) value, and thereafter increases. Therefore, the electrical energy necessary to achieve a given magnetization (the exciting power) is minimized for an optimally-annealed alloy. Presently, transformer core manufacturers employ amorphous alloy exhibiting exciting power values at 60 Hz and 1.4 T (at 25° C.) of about 1 VA/kg or less.

It should be apparent that optimum annealing conditions are different for amorphous alloys of different compositions, and for each property required. Consequently, an "optimum" anneal is generally recognized as that annealing process which produces the best balance between the combination of characteristics necessary for a given application. In the case of transformer core manufacture, the manufacturer determines a specific temperature and time for annealing which are "optimum" for the alloy employed and does not deviate from that temperature or time.

In practice, however, annealing furnaces and furnace control equipment are not precise enough to maintain exactly the optimum annealing conditions selected. In addition, because of the size of the cores (typically 200 kg) and the configuration of furnaces, cores may not heat uniformly, thus producing over-annealed and under-annealed core portions. Therefore, it. is of utmost importance not only to provide an alloy which exhibits the best combination of properties under optimum conditions, but also to provide an alloy which exhibits that "best combination" over a range of annealing conditions. The range of annealing conditions under which a useful product can be produced is referred to as an "annealing (or anneal) window".

As stated earlier, the optimum annealing temperature and time for metallic glass presently used in transformer manufacture is a temperature in the range of 20–110 K. below the crystallization temperature of the alloy (for presently employed alloy, 643–653 K.) for a time of between 1.5–2.0 hours.

The alloys of the present invention offer an annealing window of about 40 K. for the same optimum anneal time. Thus, alloys of the present invention can be subjected to annealing temperature variations of about ±20 K. from the optimum annealing temperature and still retain the combination of characteristics essential to the economical production of transformer cores. Moreover, the alloys of the present invention show unexpectedly enhanced stability in each of the characteristics of the combination over the range of the anneal window; a characteristic which enables the transformer manufacturer to more reliably produce uniformly performing cores.

Table 1 hereinbelow identifies twenty-two alloys having compositions in the range of from about 79–82 iron, 8–12.5 boron and 6–12 silicon.

TABLE 1

| | nominal at. % | | | measured at. % | | |
|---|---|---|---|---|---|---|
| No. | Fe | B | Si | Fe | B | Si |
| 1 | 82 | 8 | 10 | 81.9 | 8.2 | 9.9 |
| 2 | 82 | 9 | 9 | 81.9 | 9.1 | 9.0 |
| 3 | 82 | 10 | 8 | 81.8 | 10.2 | 7.9 |
| 4 | 82 | 11 | 7 | 81.7 | 11.2 | 7.1 |
| 5 | 81.5 | 9.5 | 9 | 81.3 | 9.7 | 9.0 |
| 6 | 81 | 8 | 11 | — | — | — |
| 7 | 81 | 9 | 10 | 81.0 | 9.1 | 9.9 |
| 8 | 81 | 10 | 9 | 80.8 | 10.2 | 9.0 |
| 9 | 81 | 11 | 8 | 80.8 | 11.2 | 7.9 |
| 10 | 81 | 12.5 | 6.5 | 81.3 | 12.6 | 6.1 |
| 11 | 80.5 | 9.5 | 10 | 80.4 | 9.7 | 9.9 |
| 12 | 80 | 8 | 12 | 79.9 | 8.2 | 11.9 |
| 13 | 80 | 9 | 11 | 79.8 | 9.1 | 11.1 |
| 14 | 80 | 9.5 | 10.5 | 80.0 | 9.6 | 10.4 |
| 15 | 80 | 10 | 10 | 80.0 | 10.2 | 9.8 |
| 16 | 80 | 11 | 9 | 79.8 | 11.2 | 9.0 |
| 17 | 80 | 11.5 | 8.5 | 80.1 | 11.5 | 8.4 |
| 18 | 79.5 | 10 | 10.5 | 79.5 | 10.1 | 10.4 |
| 19 | 79.5 | 11 | 9.5 | 79.3 | 11.3 | 9.4 |
| 20 | 79.5 | 12.2 | 8.3 | 79.5 | 12.3 | 8.2 |
| 21 | 79 | 10 | 11 | 78.8 | 10.3 | 10.9 |
| 22 | 79 | 11 | 10 | 78.9 | 11.2 | 9.9 |

The compositions identified in Table 1 were actually cast, annealed and characterized. The results of the tests conducted on these alloys is presented in FIGS. 2–9 . The compositions as recited in the right half of the table represent the measured atomic percentages of Fe, B and Si in each of the alloys actually tested. The compositions as recited in the left half of the table are used in FIGS. 2–9 to more easily identify the alloys tested.

Each of the alloys recited in Table 1 was cast in accordance with the following procedure: The alloys were cast on a hollow, rotating cylinder, open at one side thereof. The cylinder had an outer diameter of 25.4 cm and a casting surface having a thickness of 0.25" (0.635 cm) and a width of 2" (5.08 cm). The cylinder was made from a Cu—Be alloy produced by Brush-Wellman (designated Brush-Wellman Alloy 10). The constituent elements of the alloys tested were mixed in appropriate proportions, starting from high purity (B=99.9%, and Fe and Si at least 99.99% pure) raw materials, and melted in a 2.54 cm diameter quartz crucible to yield homogenized, pre-alloyed ingots. These ingots were loaded into a second quartz crucible (2.54 cm diameter), with the bottom ground flat and containing a rectangular slot of dimensions 0.25"×0.02" (0.635 cm×0.051 cm), positioned 0.008" (≈0.02 cm) from the casting surface of the cylinder. The cylinder was rotated at a peripheral speed of about 9,000 feet per minute (45.72 m/s). The second crucible and wheel were enclosed within a chamber pumped down to a vacuum of about 10 μm Hg. The top of the crucible was capped and a slight vacuum was maintained in the crucible (a pressure of about 10 Mm Hg). A power supply (Pillar Corporation 10 kW), operating at about 70% of peak power, was used to induction melt each of the ingots. When the ingot was fully molten the vacuum in the crucible was released, enabling the melt to contact the wheel surface and be subsequently quenched into ribbons about 6 mm wide via the principle of planar flow casting disclosed in U.S. Pat. No. 4,142,571.

Referring now to FIGS. 2–9, the relevant characteristics of each of the alloys recited in Table 1 are reported. In addition, expected properties of alloys having the compositions $Fe_{80.5}B_{10.5}Si_9$, $Fe_{80.5}B_{10.75}Si_{8.75}$, $Fe_{80.5}B_{11}Si_{8.5}$, $Fe_{79.8}B_{9.8}Si_{10.4}$, $Fe_{79.8}B_{11}Si_{9.2}$, $Fe_{79.8}B_{11.5}Si_{8.7}$, $Fe_{80.3}B_{10.5}Si_{9.2}$ and $Fe_{80.15}B_{9.8}Si_{10.05}$ are also included. Alloys within the scope of the present invention are illustrated by a solid black square or diamond and a solid or open circle, with the alloys being labeled with the same reference numerals as used in FIG. 1. Alloys outside the scope of the invention are illustrated by open squares or diamonds.

Figure 2:
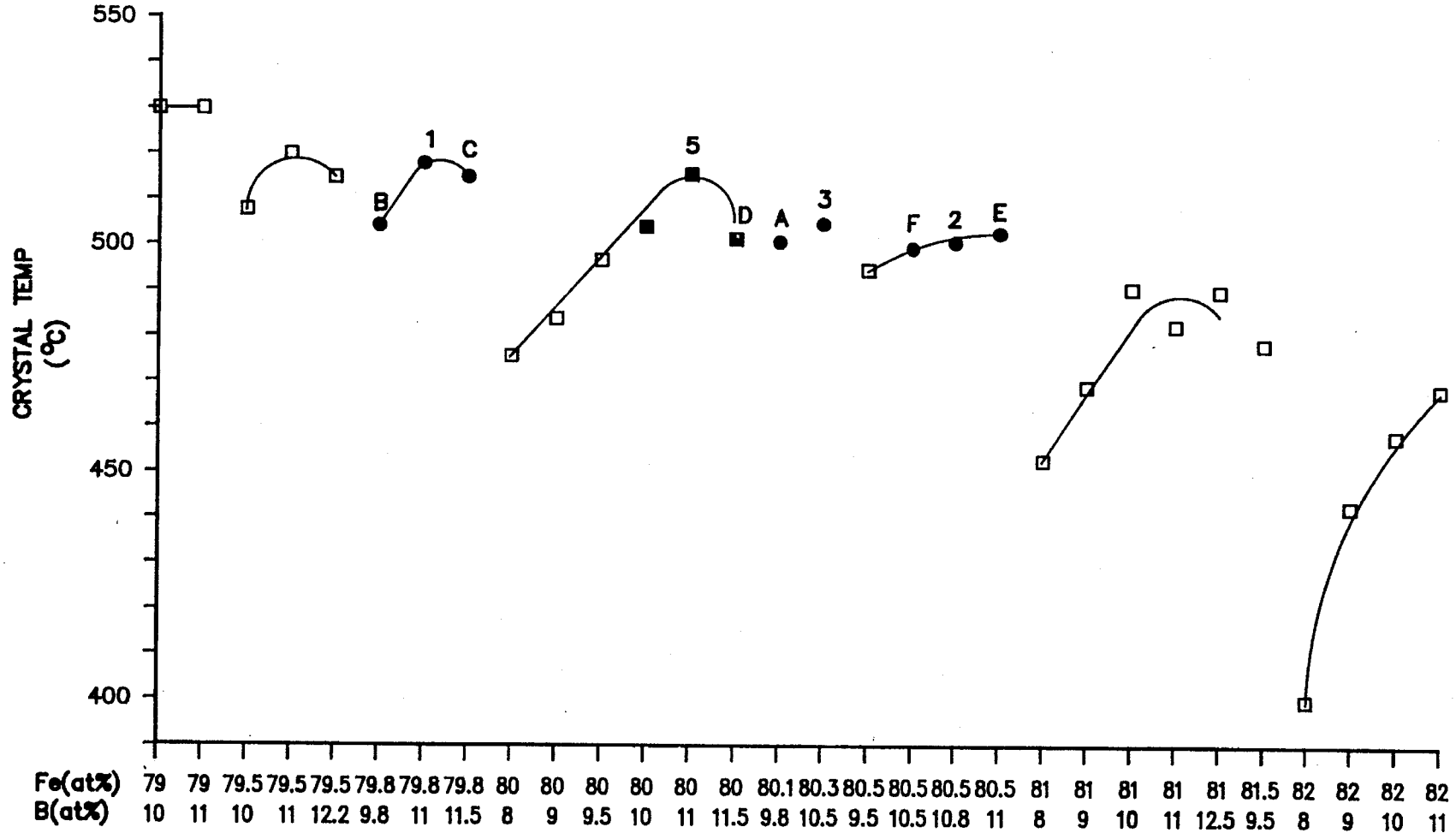
FIG. 2 is a graph illustrating the effects on crystallization temperature of increasing iron content over a range of boron concentrations and increasing boron content in alloys of constant iron concentration.

The first crystallization temperature of a variety of alloys having iron content ranging from about 79 to about 82 atom percent (nominal) boron contents ranging from about 8 to about 12 atom percent, remainder essentially silicon, are reported in FIG. 2.

It is apparent from the reported results that as iron increases, crystallization temperature decreases. In addition, for a given iron content, crystallization generally peaks at boron contents between 10 and 12, with the highest value of crystallization occurring generally at about 11 for a given value of iron within the range of 79–82. As stated previously, the crystallization temperature of an alloy useful in the production of transformer cores should be at least about 490° C. (763 K.). A crystallization temperature of at least about 490° C. is necessary to ensure that, during annealing or in use in a transformer (particularly in the event of a current overload), the risk of inducing crystallization into the alloy is minimized. The crystallization temperature of these alloys was determined by Differential Scanning Calorimetry. A scanning rate of 20 K./min. was used, and the crystallization temperature was defined as the temperature of onset of the crystallization reaction.

Figure 3:
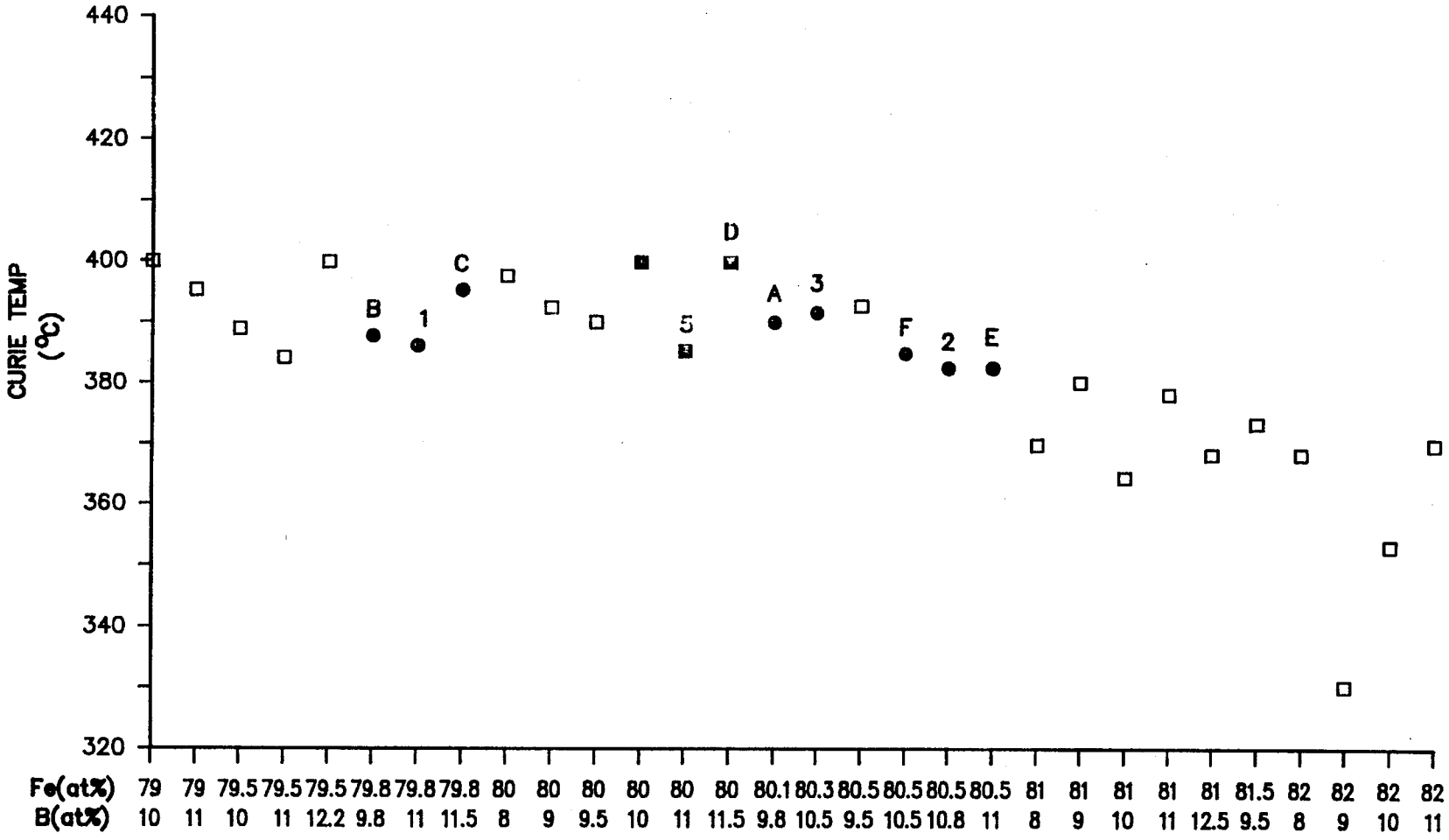
FIG. 3 is a graph illustrating the effects on Curie temperature of increasing iron content over a range of boron concentrations and increasing boron content in alloys of constant iron concentration.

FIG. 3 is a plot of Curie temperature (on heating) of all alloys reported in FIG. 2. As stated previously, the Curie temperature of the alloy should be close to and most preferably slightly higher than the temperature employed during annealing. The closer the annealing temperature is to the Curie temperature, the easier it is to align the magnetic domains in a preferred axis which tends to minimize losses exhibited by the alloys when measured in that same direction. From the data reported in FIG. 3, the Curie temperature of alloys of the present invention is at least about 360° C. and generally is at least about 370° C. or more.

The Curie temperature was determined using an inductance technique. Multiple helical turns of copper wire in a Fiberglas sheath, identical in all respects (length, number and pitch), were wound onto two open-ended quartz tubes. The two sets of windings thus prepared had the same inductance. The two quartz tubes were placed in a tube furnace, and an AC exciting signal (with a fixed frequency ranging between about 2 kHz and 10 kHz) was applied to the prepared inductors, and the balance (or difference) signal from the inductors was monitored. A ribbon sample of the alloys to be measured was inserted into one of the tubes, serving as the "core" material for that inductor. The high permeability of the ferromagnetic core material caused an imbalance in the values of the inductances and, therefore, a large signal. A thermocouple attached to the alloy ribbon served as the temperature monitor. When the two inductors were heated up in an oven, the imbalance signal essentially dropped to zero when the ferromagnetic metallic glass passed through its Curie temperature and became a paramagnet (low permeability). The two inductors then yielded about the same out put. The transition region is usually broad, reflecting the fact that the stresses in the as-cast glassy alloy are relaxing. The midpoint of the transition region was defined as the Curie temperature.

In the same fashion, when the oven was allowed to cool, the paramagnetic-to-ferromagnetic transition could be detected. This transition, from the at least partially relaxed glassy alloy, was usually much sharper. The paramagnetic-to-ferromagnetic transition temperature was higher than the ferromagnetic-to-paramagnetic transition temperature for a given sample. The quoted values for the Curie temperatures represent the ferromagnetic-to-paramagnetic transition.

Figure 4:
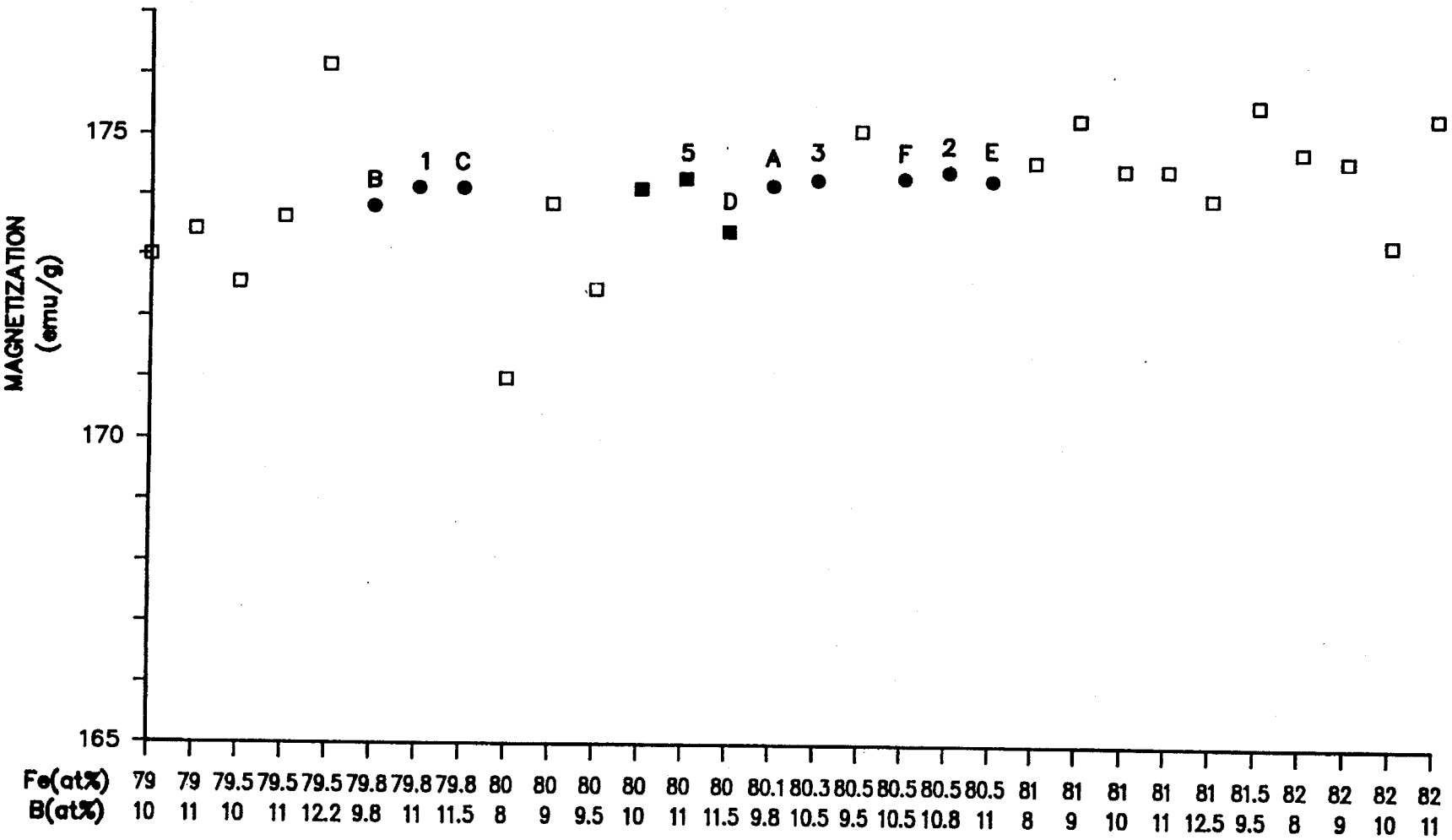
FIG. 4 is a graph illustrating the saturation magnetization values for a variety of alloys within and outside the scope of the present invention and, more particularly, the effect of increasing iron content on saturation magnetization values.

FIG. 4 is a plot of saturation magnetization values as a function of alloy composition. As stated previously, saturation magnetization values of alloys preferred for use in transformer core manufacture is at least about 174 emu/g. From the data of FIG. 4, in general, increased iron content coupled with increased boron content yields increased saturation magnetization values. More specifically, alloys having an iron content less than about 79.8 atom percent and boron content less than about 9.8 atom percent would not exhibit saturation magnetization values which would be preferred for use in the production of transformer cores.

The values for the saturation magnetization quoted are those obtained from as-cast ribbons. It is well-understood in the art that the saturation magnetization of an annealed metallic glass alloy is usually higher than that of the same alloy in the as-cast state, for the same reason as stated above: the glass is relaxed in the annealed state.

A commercial vibrating sample magnetometer was used for the measurement of the saturation magnetic moment (or, as referred to here, saturation magnetization) of these alloys. As-cast ribbon from a given alloy was cut into several small squares (approximately 2 mm×2 mm), which were randomly oriented about a direction normal to their plane, their plane being parallel to maximum applied field of about 755 kA/m. By using the measured mass density, the saturation induction, $B_s$, may then be calculated. The density of many of these alloys was measured using standard techniques based upon Archimedes' Principle.

Figure 5:
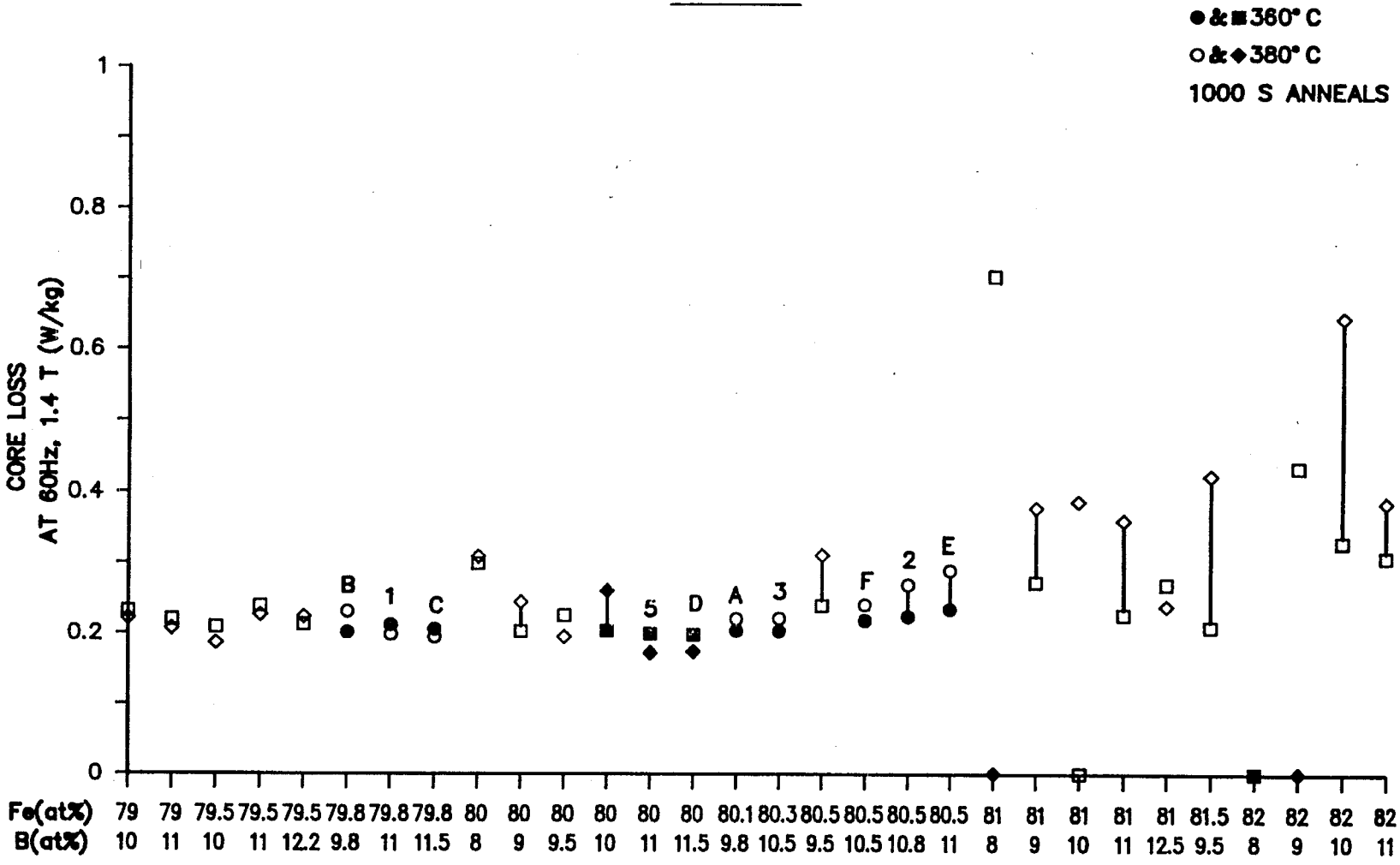
FIG. 5 is a graph illustrating the results of core loss measurements at 60 Hz, 1.4 T and 25° C. for a variety of alloys subjected to annealing at two different annealing temperatures, each for a period of 2000 s at temperature.

FIG. 5 is a plot of core loss at 60 Hz and 1.4 T (at room temperature, 25° C.) for alloy strip which has been annealed at 360° C. for 1,000 seconds (or at 380° C. for 1,000 seconds) versus alloy composition. The horizontal line drawn at about 0.30 W/kg represents maximum core loss value for alloys of the present invention. Most preferably, the core loss results should be such that after annealing under either set of conditions the core loss remains at or below about 0.25 W/kg. The spread between the 360° C. and 380° C. values for each alloy indicates the potential anneal window for that alloy. Certain data points on the graph (for example, for alloys $Fe_{81}B_8$, $Fe_{81}B_{10}$, $Fe_{82}B_9$ and $Fe_{82}B_8$), indicate values of zero core loss under certain annealing conditions. A core loss value of zero indicates that the alloy could not be driven at 60 Hz to 1.4 T after having been annealed under the reported conditions in order to generate a core loss value. The most preferred alloys of the present invention exhibit core loss values less than or equal to about 0.25 W/kg.

Figure 6:
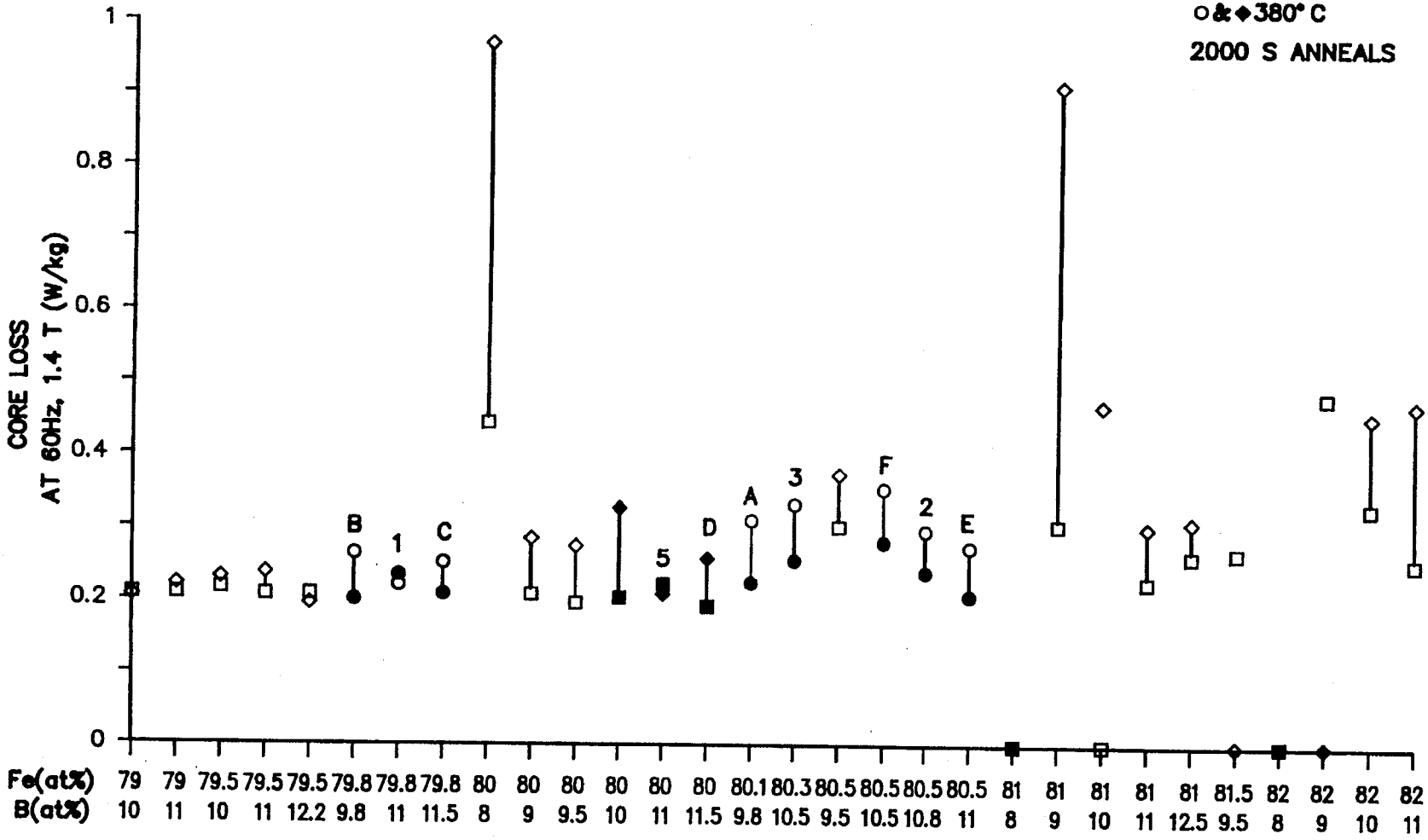
FIG. 6 is a graph illustrating the results of core loss measurements at 60 Hz, 1.4 T and 25° C. for a variety of alloys subjected to annealing at two different annealing temperatures, each for a period of 2000 s at temperature.

FIG. 6 is a plot of core loss at 60 Hz and 1.4 T (at 25° C.) for alloy strip which had been annealed at 360° C. for 2,000 seconds (or at 380° C. for 2,000 seconds) versus alloy composition. As illustrated in FIG. 6, core loss values for alloys of the present invention were less than or equal to about 0.3 W/kg under either set of conditions. These results when coupled with the results of FIG. 5 illustrate a significant annealing window with respect to the core loss values obtained by alloys of the present invention. As in FIG. 5, core loss values reported as zero core loss indicate alloy strip which could not be driven to 1.4 T at 60 Hz after having been annealed under the recited conditions.

Figure 7:
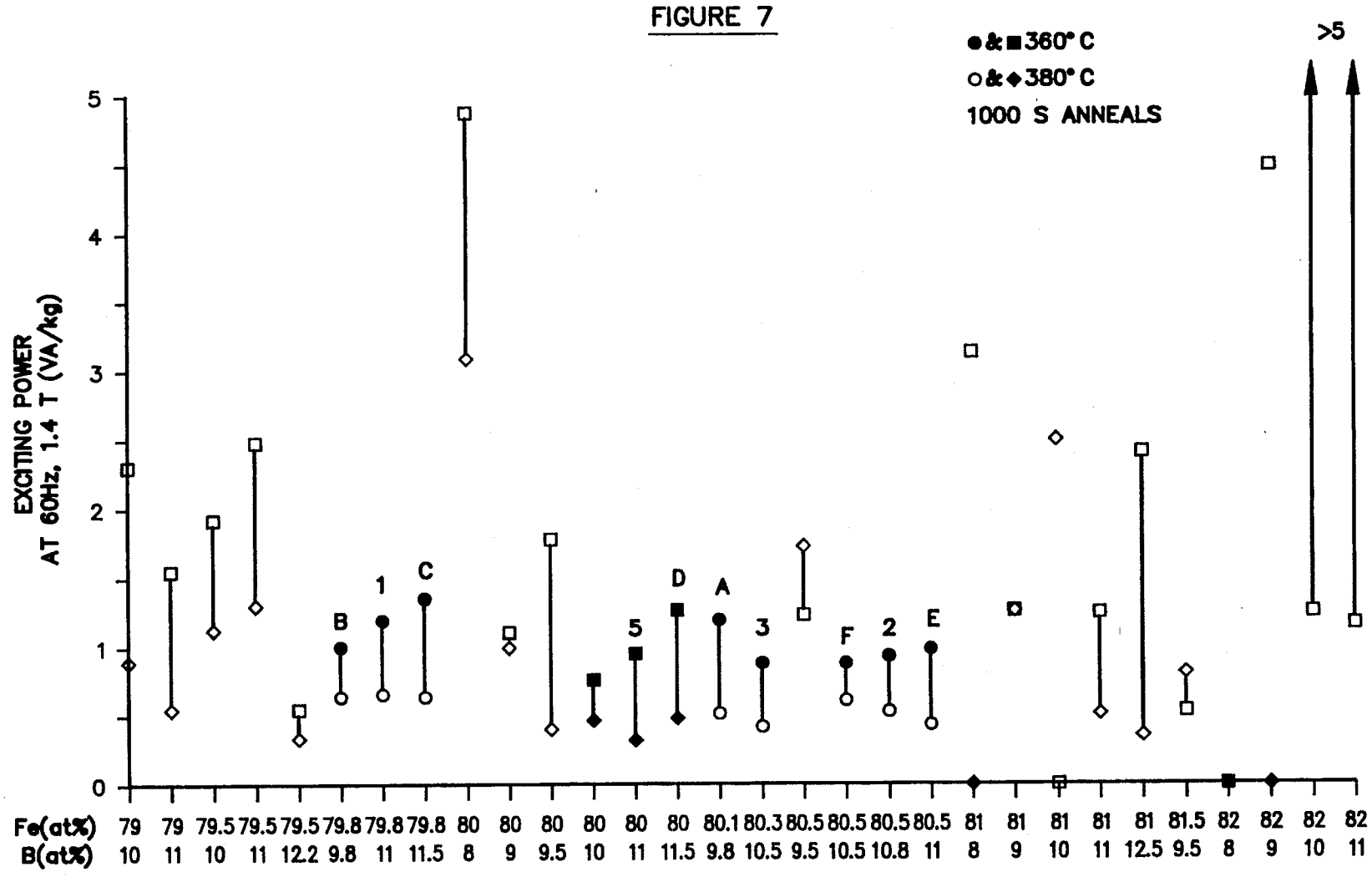
FIG. 7 is a graph illustrating the exciting power requirements measured at 60 Hz, 1.4 T and 25° C. for a variety of alloys subjected to annealing at two different annealing temperatures, each for a period of 1000 s at temperature.
Figure 8:
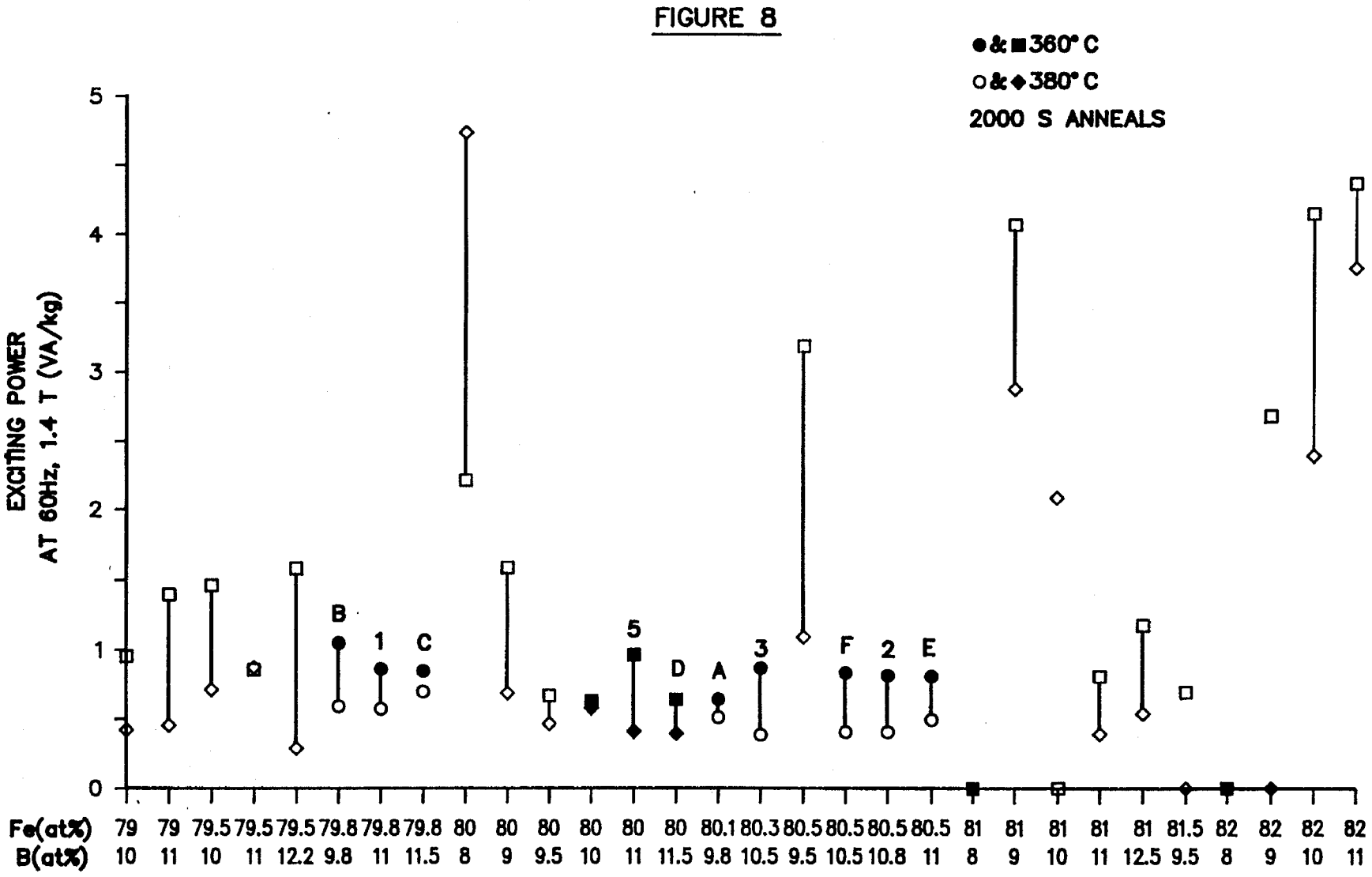
FIG. 8 is a graph illustrating the exciting power requirements measured at 60 Hz, 1.4 T and 25° C. for a variety of alloys subjected to annealing at two different annealing temperatures, each for a period of 2000 s at temperature.

FIGS. 7 and 8 plot exciting power values under the same annealing conditions as employed for the determination of core loss values of the alloys reported in FIGS. 5 and 6, respectively, versus alloy composition. From the data reported in FIGS. 7 and 8, it is readily apparent that the alloys of the present invention exhibit low exciting power values under all four sets of annealing conditions but also show relative stability of the exciting power value as compared to alloys outside the scope of the present invention.

The core loss and exciting power data were gathered as follows:

Toroidal samples for annealing, and subsequent magnetic measurements, were prepared by winding as-cast ribbons onto ceramic bobbins so that the mean path length of the ribbon core was about 126 mm. Insulated primary and secondary windings, each numbering 100, were applied to the toroids for the purpose of measurements of core loss. Toroidal samples so prepared contained between 2 and 5 g of ribbon. Annealing of these toroidal samples was carried out at 613–653 K. for 1–5.4 ks in the presence of an applied field of about 795 A/m imposed along the length of the ribbon (toroid circumference). This field was maintained while the samples were cooled following the anneal. Unless otherwise mentioned, all anneals were conducted under vacuum.

The total core loss was measured on these closed-magnetic-path samples under sinusoidal flux conditions using standard techniques. The frequency (f) of excitation was 60 Hz, and the maximum induction level ($B_m$) that the cores were driven to was 1.4 T.

While certain alloys outside the scope of the present invention may, in some instances, show core loss values or exciting power values approximately equivalent to alloys within the scope of the present invention, alloys outside of the scope of the present invention do not show a combination of low core loss values and exciting power values equivalent to alloys of the present invention. It is this combination of exciting power and core loss in further combination with the above-discussed characteristics and the ductility (to be discussed more fully below), and the relative consistency and uniformity of the properties under all of the reported annealing conditions which is characteristic of, but unexpected from, alloys of the present invention.

Figure 9:
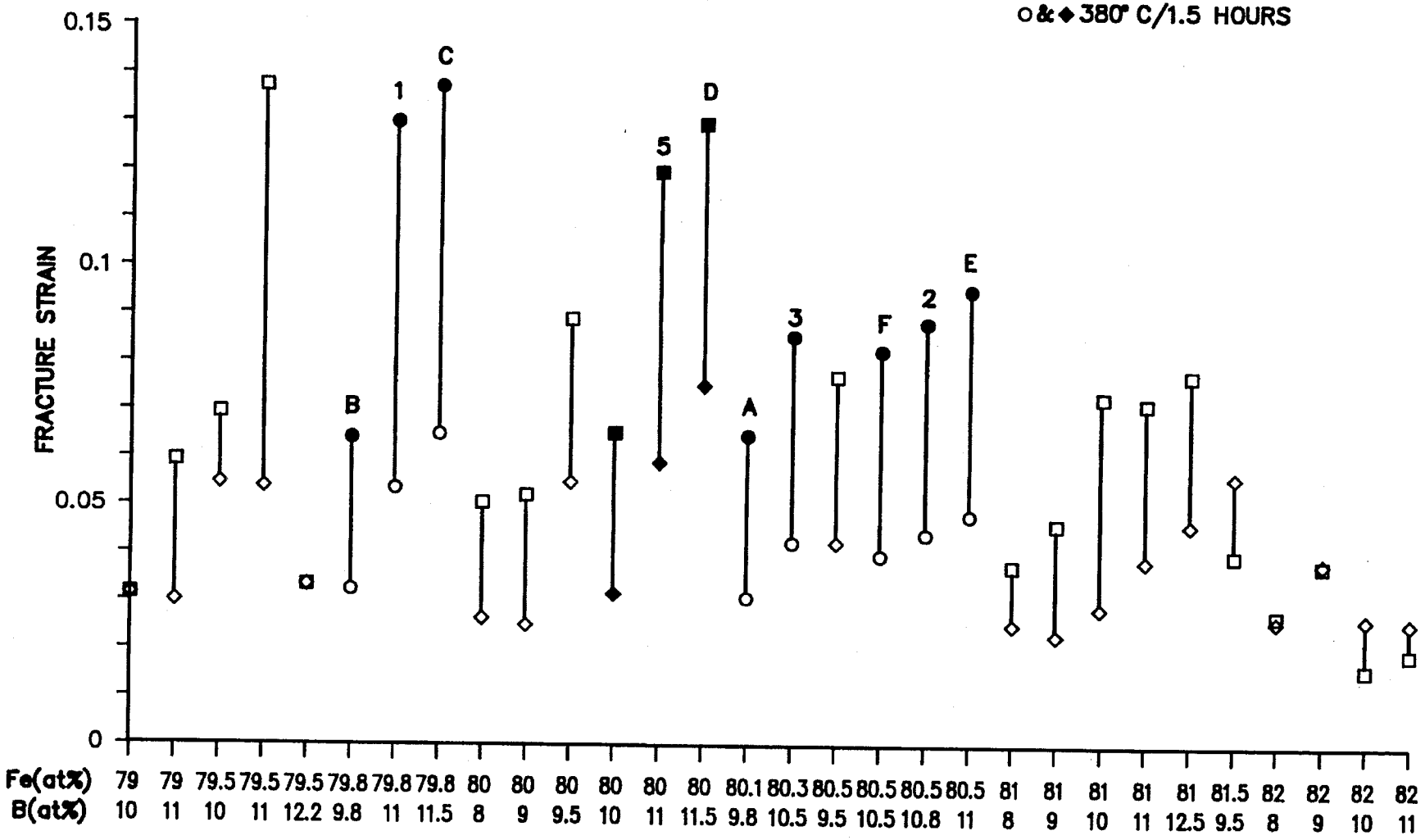
FIG. 9 illustrates on a comparative basis the change in ductility of a variety of alloys as the annealing temperature changes from 360° C. (1.5 hours) to 380° C. (1.5 hours).

Turning now to FIG. 9, this figure is a plot of fracture strain for alloys which have been annealed at 360° C. for 1.5 hours and alloys which have been annealed at 380° C. for 1.5 hours versus alloy composition. Each data point of the graph is the mean of at least five measurements for each alloy composition. As stated previously, the fracture strain value exhibited by presently utilized amorphous alloy is approximately 0.03 or less, which translates to a round radius of about 17 times the thickness of the strip or less prior to the onset of fracture. The alloys of the present invention exhibit a fracture strain value of at least 0.03 under either set of annealing conditions, and in many instances exhibit a fracture strain value of at least about 0.05 (approximately equivalent to a bend diameter of 20 times thickness of the ribbon, i.e. a round radius of ten times thickness of the ribbon, without fracture). As is clear from the results reported, most alloys of the present invention exhibit fracture strain values of at least about 0.05 or greater under one set of conditions, which represents a dramatic improvement in ductility over the prior art material, and for many alloys the fracture strain values under both sets of annealing conditions are least about 0.05.

Characterization of the fracture strain was conducted on straight strip samples, ranging in lengths between 25 mm and 100 mm, annealed at the stated conditions. The annealed samples were bent between the platens of a micrometer until they fractured, and the separation, d, between the platens was noted. The fracture strain was then calculated as described above. The separation, d, was measured at a minimum of three different points on each of at least three different ribbon samples of a given nominal composition.

We have discovered a class of alloys which exhibit the combination of properties essential to the production of transformer cores. The alloys exhibit excellent properties over a range of annealing conditions which, as a result, assures the transformer manufacturer of the production of quality, more uniform product. These advantages are not available with the prior art materials nor could such advantages have been envisioned heretofore.

We claim:

1. A metallic alloy consisting essentially of iron, boron and silicon and having a composition in the region A, B, C, D, E, F, A of FIG. 1, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

2. A metallic alloy consisting essentially of iron, boron and silicon and having a composition in the region 4, C, D, E, F, 4 of FIG. 1, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

3. A metallic alloy consisting essentially of iron, boron and silicon and having a composition in the region 1, C, 2, F, 3, 1 of FIG. 1, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

4. The alloy of claim 1 wherein the alloy is at least 90% amorphous.

5. The alloy of claim 2 wherein the alloy is at least 90% amorphous.

6. The alloy of claim 3 wherein the alloy is at least 90% amorphous.

7. A metallic alloy consisting essentially of a composition represented by the formula $Fe_aB_bSi_c$ where "a", "b" and "c" are in atomic percent and "a" is in the range of 79.8–80.5, "b" is in the range of 9.8–11.5, and "c" is in the range of 8.5–10.4, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

8. A metallic alloy consisting essentially of iron, boron and silicon, where boron is present in an amount ranging from about 10.5 to about 11.5 atom percent, silicon is present in an amount ranging from about 8.5 to about 9.5 atom percent, and iron is present in an amount ranging from at least 80 atom percent to about 80.5 atom percent, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

9. An amorphous metallic alloy consisting essentially of about 80 atom percent iron, about 11 atom percent boron and about 9 atom percent silicon, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

10. The alloy of claim 7 wherein the core loss is not greater than about 0.25 W/kg.

11. The alloy of claim 7 wherein the exciting power requirement is not greater than about 0.75 VA/kg.

12. An amorphous metallic alloy consisting essentially of about 80 atom percent iron, about 10 atom percent boron and about 10 atom percent silicon, said alloy having been annealed and having a crystallization temperature of at least about 490° C., a saturation magnetization value of at least about 174 emu/g at 25° C., a core loss not greater than about 0.3 W/kg, measured at 25° C., 60 Hz and 1.4 T and an exciting power not greater than about 1 VA/kg, measured at 25° C., 60 Hz and 1.4 T.

13. An article of manufacture comprising an alloy of claim 1.

14. A magnetic core comprising metallic strip formed of an alloy of claim 1 wherein the alloy is at least about 90% amorphous.

* * * * *